US008091865B2

(12) United States Patent
Eric

(10) Patent No.: US 8,091,865 B2
(45) Date of Patent: Jan. 10, 2012

(54) LEVER BAR

(76) Inventor: Lachance Eric, Chertsey (CA)

( * ) Notice: Subject to any disclaimer, the term of this patent is extended or adjusted under 35 U.S.C. 154(b) by 370 days.

(21) Appl. No.: 12/407,564

(22) Filed: Mar. 19, 2009

(65) Prior Publication Data

US 2010/0237301 A1 Sep. 23, 2010

(51) Int. Cl.
*B66F 15/00* (2006.01)
*B25C 11/00* (2006.01)

(52) U.S. Cl. ..... 254/25

(58) Field of Classification Search ..... 254/25, 254/26 R, 18; 7/166
See application file for complete search history.

(56) References Cited

U.S. PATENT DOCUMENTS

| | | | | | |
|---|---|---|---|---|---|
| 742,771 | A | * | 10/1903 | Arrington | 254/26 R |
| 795,876 | A | * | 8/1905 | Willhide | 254/25 |
| 1,961,050 | A | * | 5/1934 | Johnson | 254/25 |
| 2,457,231 | A | * | 12/1948 | Henderson | 254/25 |
| 2,525,226 | A | * | 10/1950 | Lawellin | 254/25 |
| 2,906,498 | A | * | 9/1959 | Erwin | 254/25 |
| D251,540 | S | * | 4/1979 | Faltin | D8/6 |
| D295,715 | S | * | 5/1988 | Garrett | D8/79 |
| 4,785,488 | A | | 11/1988 | Schellas | |
| 4,826,136 | A | * | 5/1989 | Thomas | 254/25 |
| 5,674,002 | A | | 10/1997 | Powell | |
| 5,695,172 | A | * | 12/1997 | Hreha | 254/25 |
| 5,749,113 | A | * | 5/1998 | Witter | 7/166 |
| 6,113,074 | A | * | 9/2000 | Foley | 254/25 |
| 6,663,083 | B1 | | 12/2003 | Smith | |
| 7,364,133 | B2 | * | 4/2008 | Eby et al. | 254/25 |
| 7,690,627 | B2 | * | 4/2010 | Harpell | 254/25 |
| 2007/0114501 | A1 | | 5/2007 | Eby | |
| 2007/0226913 | A1 | * | 10/2007 | Woolley et al. | 7/146 |

FOREIGN PATENT DOCUMENTS

| | | |
|---|---|---|
| JP | 04007465 | 10/1992 |
| JP | 09131670 | 5/1997 |

* cited by examiner

*Primary Examiner* — David B Thomas

(57) ABSTRACT

An improved lever bar has an elongated shaft having two opposite distal ends. The first of the two opposite distal ends includes a crescent shaped portion having opposite end portions, both of the crescent opposite end portions respectively include flattened, clawed portions; and the second of the two opposite distal ends includes a flattened, pointed portion.

4 Claims, 3 Drawing Sheets

LEVER BAR

FIELD OF THE INVENTION

The invention relates generally to levers and crowbars but more particularly to an improved lever bar for removing metal forms used in construction.

BACKGROUND OF THE INVENTION

The lever and its principle is one of the first tools used by man. The basic principle of leverage has been used in ancient times from building the Egyptian pyramids, Roman structures, Medieval buildings etc. and continues to be used in modern day construction.

There exist a variety of levers which fulfill varying functions. Lever bars are a basic tool used in building and demolition and its design, weight and strength often defines the number of applications it can take on.

Starting from the simple straight metal lever with a flattened end to ones with pivotable and interchangeable heads, there exist a choice of lever bars also called crow bars, pinch bars, timber bars, pry bars, claw hammers and the like.

Some levers are designed for a number of needs while the more simple designs often serve a more specific need. Construction workers often choose the one that is more suited to their needs while considering comfort, strength and ease of use.

In order to remove metal forms from buildings, current lever bars fall short in two respects, they either do not possess the correct angle for removing metal forms easily or they lack the strength due to movable joints, two part construction and/or pivotable heads.

The current invention addresses the need for an easier, stronger and more efficient lever which is more specifically designed to remove metal forms and brackets besides performing other routine tasks such as removing nails, prying floorboards, wedging, hammering, moving heavy objects etc.

SUMMARY OF THE INVENTION

In view of the foregoing disadvantages inherent in the known devices now present in the prior art, the present invention, which will be described subsequently in greater detail, is to provide objects and advantages which are:

To provide for a lever bar with a curved double sided head at one end and a flattened point at the other end. The curved head is crescent shaped and angled to the straight metal shaft or handle in such a way that it provides for two lever heads with different operating angles. The ends of these two heads are flattened and claw shaped respectively. The claws are used to pull or extrude nails and screws from forms, boards, beams, floorboards or other surfaces that it is used upon.

Another advantage of this invention is that it is constructed or moulded from one piece of metal with reinforcements strengthening the areas which are subject to maximum stress. This makes the lever bar extremely durable and able to lift heavier loads as compared to most lever bars available today.

The two angles on the double sided curved head are conceived to be most effective for removing metal forms and brackets which are often located at a higher elevation. Besides metal forms the two angles of the curved head are ideal to lift and move heavy objects about. To lift or move a heavy object such as a garbage dumpster for example, one inserts one end of the curved head under the dumpster. Depending on the lift height and/or comfort desired, one chooses one of the two angles most suited. The handle of the lever is then pressed or leveraged much as one would use a regular lever, thereby lifting the dumpster.

Similarly for removing metal forms and brackets, the nails can first be removed using the claws on either of the curved heads. Thereafter, one chooses the curved head with the angle best suited to the part of the form one wishes to pull. Inserting the flat end into the gaps, one is able to pull the form off the surface it is attached to with considerable ease also aided by its long handle. If one requires the traditional straight crow bar for certain functions or positions, the lever bar is simply reversed so as to use the flattened end at the other end of the lever bar.

More specifically, the improved lever bar is comprised of an elongated shaft having two opposite distal ends; the first of the two opposite distal ends includes a crescent shaped portion having opposite end portions, both of the crescent opposite end portions respectively include flattened, clawed portions; and the second of the two opposite distal ends includes a flattened, pointed portion.

In a preferred embodiment, the central focal radial axis of the crescent shaped portion is formed at an angle with respect to the linear axis of the elongated shaft, such that operating angles formed between respective tangential axes of the crescent end portions and the linear axis of the elongated shaft are different and thereby offer different operating angles for different mechanical leverages and purposes.

The lever bar further includes an angled neck portion connecting a base portion of the crescent shaped portion to a lower neck portion of the elongated shaft and thereby forming the angle between the central focal radial axis of the crescent shaped with respect to the linear axis of the elongated shaft.

An elongated reinforcement member is attached to the lower neck portion, to the angled neck portion, and to the base portion of the crescent shaped portion in an elongated and contiguous form to thereby increase the overall strength of the lever bar and thereby withstand the increased stresses on the portions when the lever bar is in use.

The material used to form the lever bar is chosen from a group including iron, steel, polycarbonate, fiberglass, composites, and ceramics.

The lever bar can be formed from a single mould technique.

The lever bar has its flattened, clawed portions, and flattened, pointed portion further hardened using methods that include heating and tempering techniques.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
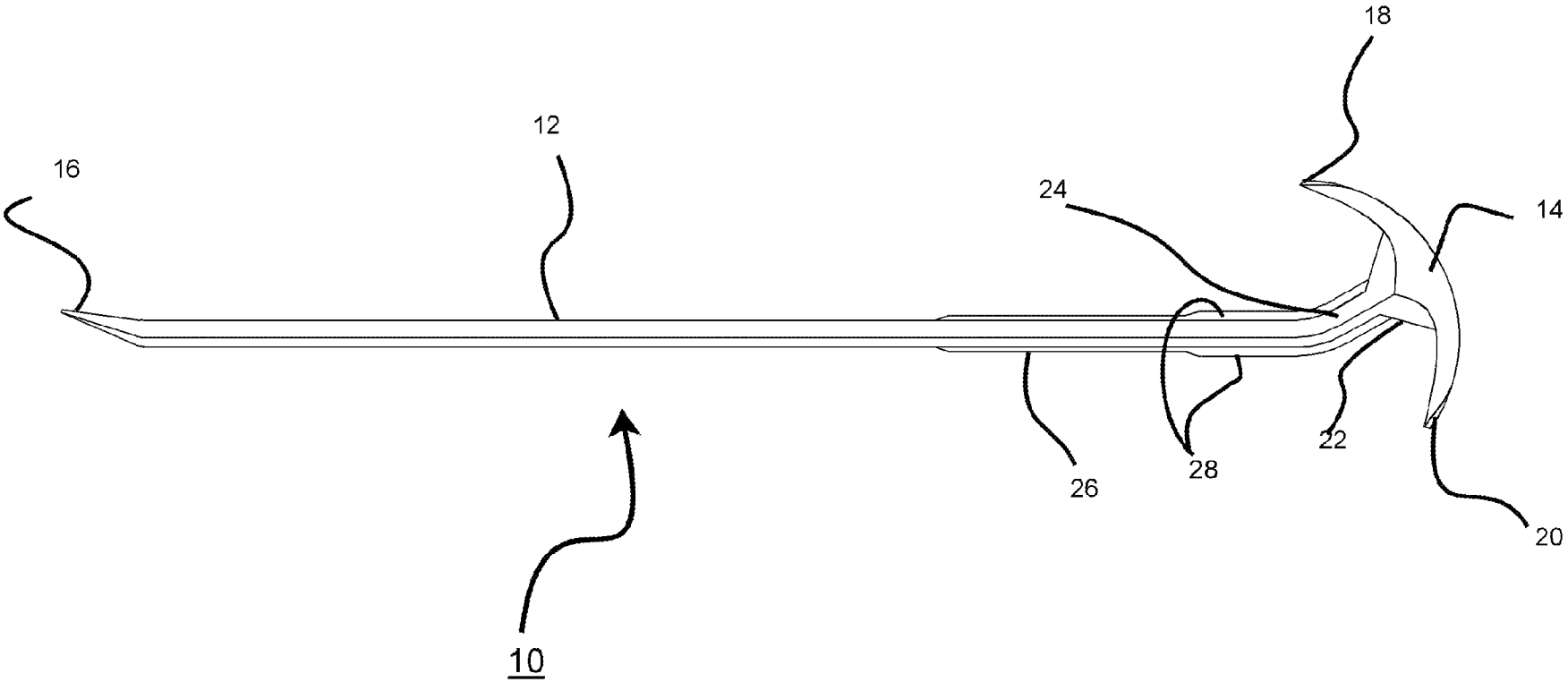
FIG. 1 Side view of the invention.
Figure 2:
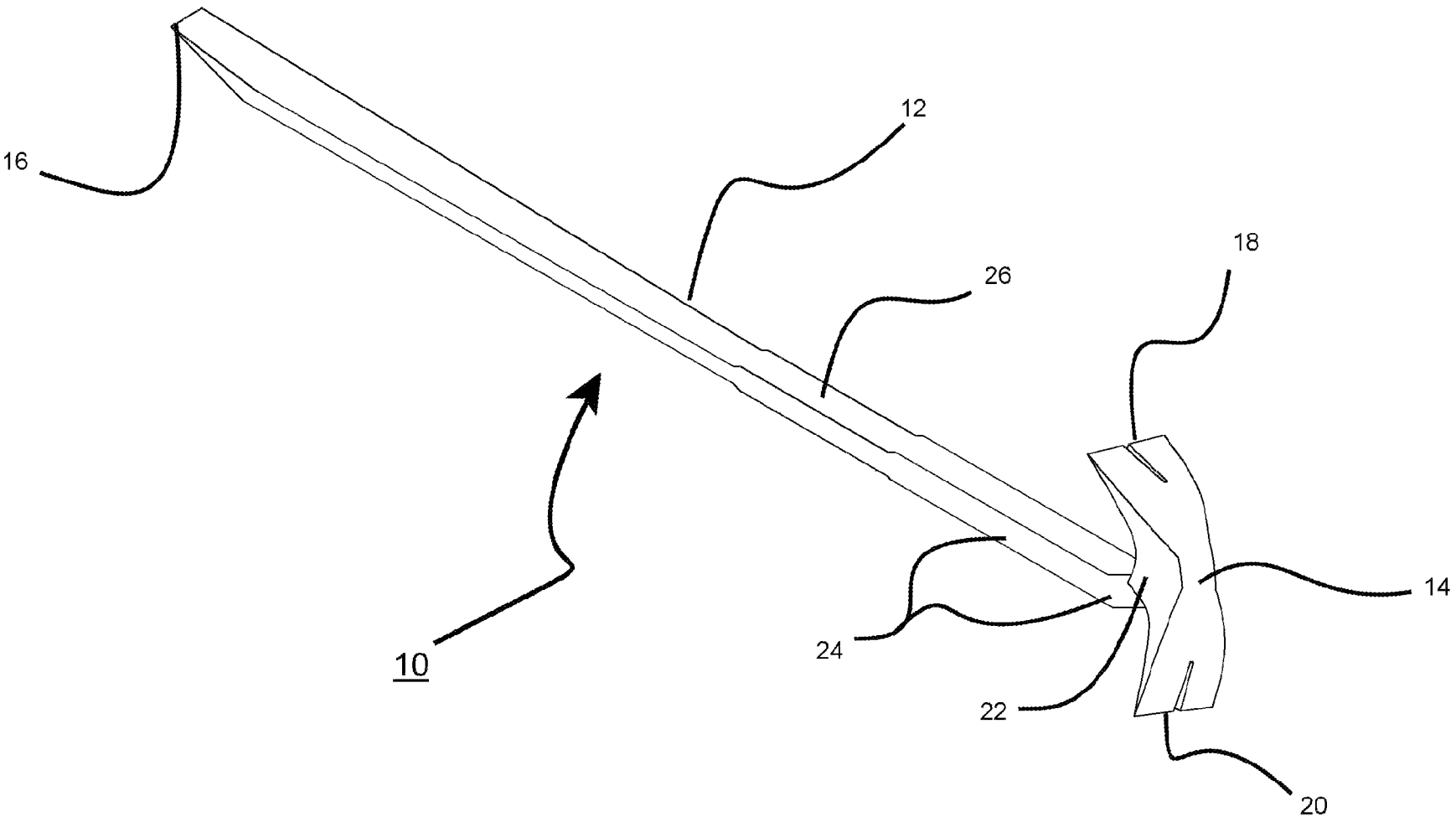
FIG. 2 Isometric view of the invention.
Figure 5:
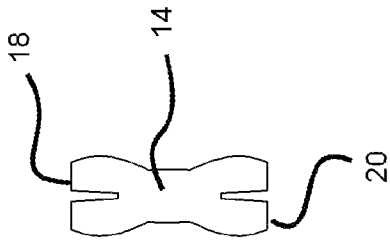
FIG. 5 Top plan view of the curved head the handle being omitted.
Figure 3:
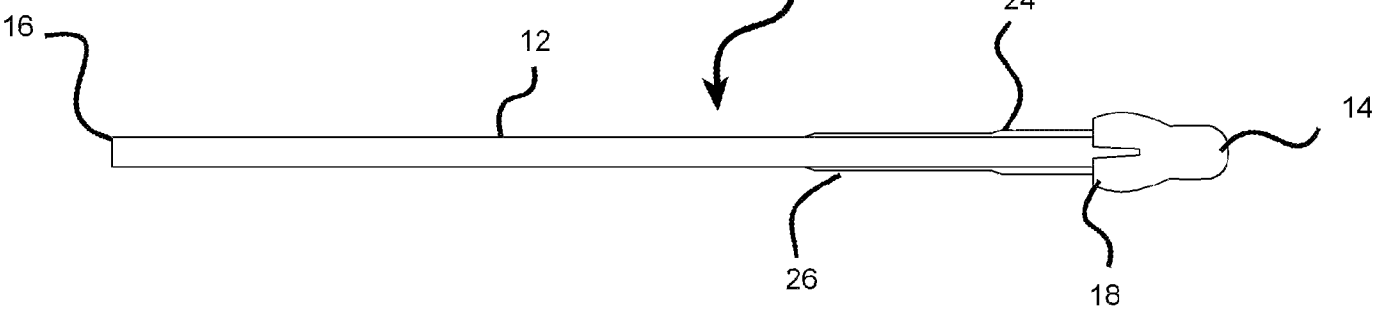
FIG. 3 View of the invention on its side.
Figure 4:
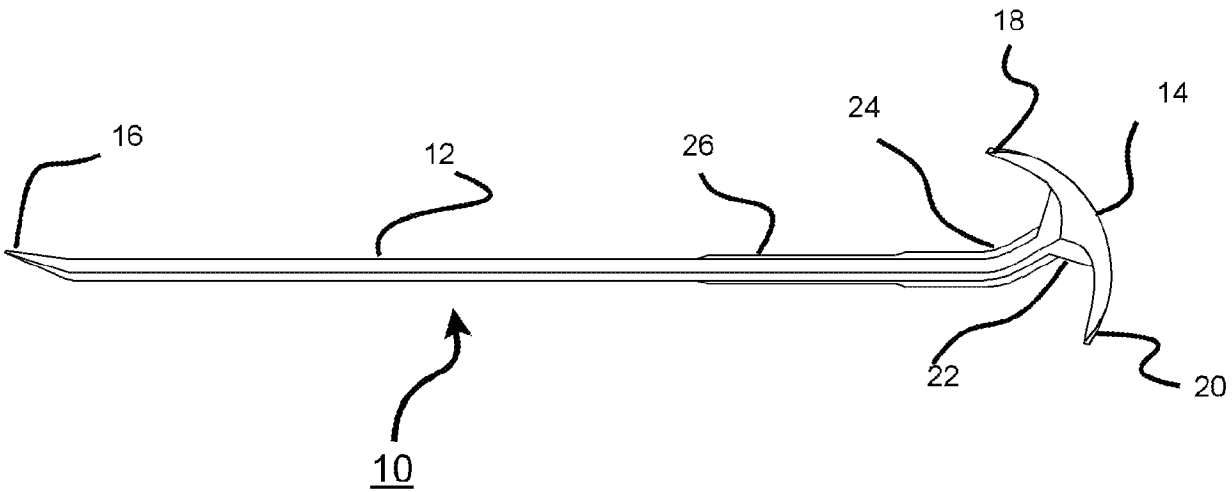
FIG. 4 Side view of the invention.

An improved lever bar (10) has an elongated shaft (12) having two opposite distal ends The first of those two opposite distal ends includes a crescent shaped portion (14) which has opposite end portions. Both of the crescent opposite end portions respectively include clawed portions (18, 20) which are flattened to gain easy access to small gaps and clawed (as seen in FIG. 2, FIG. 3 and FIG. 5) to be able to pull out nails, screws etc. (not shown). The second of the two opposite distal ends includes a flattened, pointed tip (16). The flattened pointed tip (16) serves as a normal straight crow bar along with the handle (12).

The central focal radial axis of the crescent shaped portion (14) is formed at an angle with respect to the linear axis of the elongated shaft (12) such that operating angles formed between respective tangential axes of the crescent shaped portion (14) and the linear axis of the elongated shaft (12) are different and thereby offer different operating angles for different mechanical leverages and purposes such as for removing metal forms (not shown) from building walls, ceilings and other surfaces (not shown).

The lever bar (10) further includes an angled neck portion (24) connecting a base portion (22) of the crescent shaped portion (14) to a lower neck portion (26) of the elongated shaft (12) and thereby forming the angle between the central focal radial axis of the crescent shaped portion (14) with respect to the linear axis of the elongated shaft (12).

An elongated reinforcement member (28) is attached to the lower neck portion (24), and to the base portion (22).

The material used to form the lever bar (10) is chosen from a group including iron, steel, polycarbonate, fiberglass, composites, and ceramics. Additionally, the lever bar (10) can be formed from a single mould technique.

The lever bar (10) has its flattened, clawed portions, and flattened, pointed portion further hardened using methods that include heating and tempering techniques.

When in use, depending on the angle and access available, one of either clawed portions (18) and (20) can be chosen. With its flattened end inserted into the gaps between the forms (not shown) and the handle (12) pulled and/or leveraged to remove the forms (not shown) from the surface (not shown) it is adhering to.

Nails and screws (not shown) can also be removed using the clawed portions (18) and (20) during the process. The elongated shaft (12) allows one easy reach to the metal forms (not shown) which are often located high and close to ceilings of buildings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A lever bar comprising:

an elongated shaft having two opposite distal ends;

the first of said two opposite distal ends includes a crescent shaped portion having opposite end portions, both of the crescent opposite end portions respectively include flattened, clawed portions; and the second of said two opposite distal ends includes a flattened, pointed portion;

the central focal radial axis of said crescent shaped portion is formed at an angle with respect to the linear axis of said elongated shaft, such that operating angles formed between respective tangential axes of said crescent end portions and the linear axis of said elongated shaft are different and thereby offer different operating angles for different mechanical leverages and purposes;

said elongated shaft further includes an angled neck portion connecting a base portion of said crescent shaped portion to a lower neck portion of said elongated shaft and thereby forming said angle between the central focal radial axis of said crescent shaped with respect to said linear axis of said elongated shaft;

an elongated reinforcement member is attached to said lower neck portion, to said angled neck portion, and to said base portion of said crescent shaped portion in an elongated and contiguous form to thereby increase the overall strength of said lever bar and thereby withstand the increased stresses on said portions when said lever bar is in use.

2. The lever bar of claim 1, wherein:

the material used to form said lever bar is chosen from a group including iron, steel, polycarbonate, fiberglass, composites, and ceramics.

3. The lever bar of claim 1, wherein:

said lever bar is formed from a single mould technique.

4. The lever bar of claim 1, wherein:

said flattened, clawed portions, and said flattened, pointed portion are further hardened using methods that include heating and tempering techniques.

* * * * *